US005385588A

United States Patent [19]

Brennan et al.

[11] Patent Number: 5,385,588

[45] Date of Patent: * Jan. 31, 1995

[54] ENHANCED HYDROCARBONACEOUS ADDITIVE CONCENTRATE

[75] Inventors: Timothy J. Brennan, Collinsville, Ill.; Lawrence J. Cunningham, Kirkwood, Mo.

[73] Assignee: Ethyl Petroleum Additives, Inc., Richmond, Va.

[ * ] Notice: The portion of the term of this patent subsequent to Jan. 18, 2011 has been disclaimed.

[21] Appl. No.: 140,676

[22] Filed: Oct. 21, 1993

Related U.S. Application Data

[63] Continuation-in-part of Ser. No. 892,024, Jun. 2, 1992, Pat. No. 5,279,626.

[51] Int. Cl.[6] ..... C10L 1/22

[52] U.S. Cl. ..... 44/331; 44/451

[58] Field of Search ..... 44/331, 451

[56] References Cited

U.S. PATENT DOCUMENTS 3,474,151 10/1969 Grane ..... 260/643
5,169,410 12/1992 Wright ..... 44/415
5,279,626 1/1994 Cunningham et al. ..... 44/331

*Primary Examiner*—Jacqueline V. Howard

[57] ABSTRACT

This invention relates to a method for enhancing an additive concentrate package so as to improve its shelf-life stability comprising forming an additive concentrate containing (i) a major amount of detergent/dispersant and (ii) a minor amount of demulsifier; and admixing a solvent stabilizer composition with said additive concentrate in an amount sufficient to improve the shelf-life stability of the additive concentrate package.

26 Claims, No Drawings

ENHANCED HYDROCARBONACEOUS ADDITIVE CONCENTRATE

This application is a continuation-in-part of copending application Ser. No. 07/892,024, filed Jun. 2, 1992, now U.S. Pat. No. 5,279,626.

This invention relates to a method and composition for hydrocarbonaceous fluid additive concentrates which provides enhanced shelf-life stability.

Detergent/dispersant compositions are typically a major component of many hydrocarbonaceous fluid additive packages and are used commercially to reduce the amount of deposits in internal combustion and compression ignition engines and on engine components. By hydrocarbonaceous fluids is meant any one or more of fuels, including gasoline, diesel, jet fuel, marine fuels, and the like; or lubricants, either natural or synthetic. Detergent/dispersant compositions may be added to such hydrocarbonaceous fluids separately; however, they are generally added as part of an additive package, which package may contain other components such as demulsifiers, corrosion inhibitors, cold starting aids, dyes, metal deactivators, lubricity additives, octane improvers, cetane improvers, emission control additives, antioxidants, extreme pressure agents, metallic combustion improvers, and the like.

Typically, the additive packages containing detergent/dispersant compositions are prepared as concentrates in bulk and are added to the fuels or lubricants in amounts ranging from about 25 to about 500 pounds per thousand barrels of fuel or lubricant. These bulk concentrates, however, do not always remain clear. Components of the additive concentrates tend to separate from the package giving the package a hazy appearance. In order to assure uniform addition of all components of the package to the hydrocarbonaceous fluids, it is desirable that the components remain in a substantially homogeneous solution. Another consideration, from a commercial point of view, is the appearance of the additive package. Invariably, an additive package having a clear appearance is preferred over a hazy product, assuming all other aspects of the two products are equal. Thus, it is an object of this invention to provide a stable hydrocarbonaceous fluid additive package. It is another object of this invention to provide a means for stabilizing a hydrocarbonaceous fluid additive package for long term storage. Other objects of this invention will be evident from the ensuing description and appended claims.

THE INVENTION

This invention relates, inter alia, to a hydrocarbonaceous fluid additive package, preferably a fuel additive concentrate, characterized by having enhanced shelf-life stability. Additive concentrate packages of this invention comprise a major amount of detergent/dispersant; a minor amount of demulsifier; and an amount of solvent stabilizer composition sufficient to enhance the shelf-life stability of the additive package. It has been discovered quite surprisingly, that there is a stabilizing interaction between the components of the additive package and the solvent stabilizer composition, which interaction is present when the solvent stabilizer composition is formed from at least two particular solvents and when the ratio of one solvent to the other in the stabilizer composition is within a particular range.

In one embodiment, this invention provides an additive concentrate package characterized by having enhanced shelf-life stability comprising a) a major amount of detergent/dispersant
b) a minor amount of demulsifier; and
c) an amount of solvent stabilizer composition sufficient to enhance the shelf-life stability of the additive package.

Useful solvent stabilizer compositions contain at least one liquid aromatic hydrocarbon solvent and at least one liquid alkyl or cycloalkyl alcohol wherein the weight ratio of aromatic solvent to alcohol is within the range of from about 2:1 to about 25:1.

This discovery has thus provided a formulation and means for enhancing the stability of hydrocarbonaceous fluid additive packages, preferably fuel additive packages, so that the packages remain clear and in substantially homogeneous solution even when stored for long periods of time. Such a homogeneous clear solution assures that substantially all of the components of the additive package concentrate are added to the hydrocarbonaceous fluid. In contrast, if one or more components of the additive package separate from the solution, as evidenced by a hazy appearance of the additive package, there is no assurance that the component(s) will be added to the hydrocarbonaceous fluid in the desired amount. Thus, with the use of the methods and compositions of this invention, the storage stability of additive concentrate packages may be greatly enhanced.

In another embodiment, this invention provides a method for enhancing the shelf-life stability of an additive package. The method comprises: a) forming an additive package containing a major amount of detergent/dispersant and a minor amount of demulsifier; and b) admixing an effective amount of solvent stabilizer composition with the additive package, the effective amount being sufficient to improve the shelf-life stability of the additive package; wherein the solvent stabilizer composition comprises at least one liquid aromatic hydrocarbon solvent and at least one liquid alkyl or cycloalkyl alcohol and wherein the weight ratio of aromatic solvent to alcohol is within the range of from about 2:1 to about 25:1. By "liquid" is meant that the component exists in the liquid state at temperatures down to at least about 25° C.

A critical feature of this invention is the use of a particular solvent stabilizer composition in combination with the hydrocarbonaceous fluid additive package. The solvent stabilizer composition is formed from at least one liquid aromatic hydrocarbon solvent and at least one liquid alkyl or cycloalkyl alcohol. Combinations of more than one liquid aromatic hydrocarbon solvent, and more than one liquid alkyl or cycloalkyl alcohol may also be used.

Preferred components for use in the solvent stabilizer compositions of this invention are those which are liquid at room temperature and, for ease of handling, have boiling points or boiling ranges above about 50° C. and freezing points within the range of from about −150° C. to about 30° C.

A wide variety of liquid aromatic hydrocarbon solvents can be used with this invention such as benzene, and alkyl substituted benzene or mixtures thereof. Preferred aromatic hydrocarbon solvents may be selected from toluene, ethylbenzene, xylene, and mixtures of o-, p-, and m-xylenes, mesitylene, and higher boiling aromatic mixtures such as, Super High Flash Naphtha, Aromatic 150, and Aromatic 100 (commercially available from Chemtech). However, other mixtures of aromatic hydrocarbon solvents may also be used. Of the foregoing aromatic solvents, Aromatic 100 or Super High Flash Naphtha is particularly preferred.

The other major component of the stabilizer composition is a liquid alkyl or cycloalkyl alcohol. Useful alkyl or cycloalkyl alcohols are alcohols or mixtures thereof having from 2 to 16 carbon atoms that have freezing points below about 30° C. Suitable alcohols therefore include ethanol, n-propanol, isopropanol, cyclopropyl carbinol, n-butanol, sec-butanol, isobutanol, tert-butanol, 2-hydroxymethyl furan, amyl alcohol, isoamyl alcohol, vinylcarbinol, cyclohexanol, n-hexanol, 4-methyl-2-pentanol, 2-ethylbutyl alcohol, sec-capryl alcohol, 2-ethylhexanol, n-decanol, lauryl alcohol, isocetyl alcohol and the like or mixtures of two or more of the foregoing. Preferred are the liquid alkanols or mixtures thereof having from 6 to about 16 carbon atoms, with 2-ethylhexanol being the most preferred.

The ratio of the amount of aromatic hydrocarbon solvent to alcohol in the solvent stabilizer composition is a key feature of this invention. While not desiring to be bound by theory, it is believed that a suitable solvent stabilizer composition should contains both polar and non-polar components. Since most additive packages contain detergent/dispersants having both polar and non-polar characteristics, the incorporation of other non-polar components to the additive package may tend to reduce the solubility of the detergent/dispersant or demulsifier in the solution. By adjusting the stabilizer solvent composition by incorporation of additional non-polar material, the solubility of the components of the additive package is greatly improved. Likewise, if the additive package is predominantly polar in nature, addition of non-polar components tends to reduce the solubility of the polar components of the package. To improve the solubility of the polar components in the presence of non-polar components, additional polar solvent should be used. Accordingly, by a simple trial and error procedure, the stability of a wide variety of additive packages can be enhanced by adjusting the amount of polar and non-polar solvents in the solvent stabilizer composition.

In a preferred embodiment, the solvent stabilizer composition is used with a diesel fuel additive package containing detergent/dispersant and demulsifier. The solvent stabilizer composition typically contains a major amount of liquid aromatic hydrocarbon solvent and a minor amount of liquid alkyl or cycloalkyl alcohol. By major amount is meant that the solvent stabilizer composition contains more than about 50 percent by weight aromatic hydrocarbon solvent, preferably more than about 70 percent by weight, and most preferably from about 75 to about 90 percent by weight based on the total weight of the solvent stabilizer composition. Accordingly, the alcohol component should be present in an amount less than about 50 percent by weight, preferably less than about 30 percent by weight, and most preferably less than from about 10 to about 25 percent by weight based on the total weight of the solvent stabilizer composition. Suitable weight ratios of aromatic hydrocarbon solvent to alcohol are within the range of from about 2:1 to about 25:1. As indicated previously, the ratio of aromatic hydrocarbon solvent to alcohol can readily be determined by simple experimentation when the polar/non-polar characteristics of the additive package vary significantly from the characteristics of the packages disclosed herein. Thus, this invention can be adapted for use in a wide variety of additive packages for fuels and/or lubricants.

When combining the aromatic hydrocarbon and alcohol components to form the stabilizer solvent compositions useful with this invention, the sequence of addition of the components is not important. Thus, the aromatic hydrocarbon can be added to the additive package followed by the alcohol component. Likewise, the alcohol component can be added to the package followed by the aromatic hydrocarbon component. The components can also be premixed in the desired proportions and then added to the package all at once. If desired, the components of the stabilizer solvent system can be added essentially simultaneously to a particular additive package. While not preferred, the additive package can be added to one or more of the components of the stabilizer solvent composition. Combinations of any two or more of the foregoing sequences may also be used. To form the compositions of this invention, standard commercially available mixing equipment may be used and the components combined and mixed in a conventional manner.

Detergent/dispersants useful in forming the additive packages of this invention include the well known detergent/dispersants typically used for hydrocarbonaceous fluids. Accordingly, useful detergent/dispersants include hydrocarbyl substituted succinimides, hydrocarbyl substituted Mannich bases, hydrocarbyl substituted amines and polyamines, polyoxyalkylene carbamates, and the like. The hydrocarbyl substituted succinimides are formed by reacting polyamine with at least one acyclic hydrocarbyl-substituted succinic acylating agent.

Acyclic hydrocarbyl-substituted succinic acid or anhydride acylating agents and methods for their preparation and use in the formation of hydrocarbyl-substituted succinimides are well known to those skilled in the art and are extensively reported in the patent literature. See for example the following U.S. Pat. Nos.

| | | |
|---|---|---|
| 3,018,247 | 3,231,587 | 3,399,141 |
| 3,018,250 | 3,272,746 | 3,401,118 |
| 3,018,291 | 3,287,271 | 3,513,093 |
| 3,172,892 | 3,311,558 | 3,576,743 |
| 3,184,474 | 3,331,776 | 3,578,422 |
| 3,185,704 | 3,341,542 | 3,658,494 |
| 3,194,812 | 3,346,354 | 3,658,495 |
| 3,194,814 | 3,347,645 | 3,912,764 |
| 3,202,678 | 3,361,673 | 4,110,349 |
| 3,215,707 | 3,373,111 | 4,234,435 |
| 3,219,666 | 3,381,022 | |

The hydrocarbyl substituent of the succinimide is preferably an alkyl or alkenyl group having from 50 to 1,000 carbon atoms. Alkenyl substituents derived from poly-$\alpha$-olefin homopolymers or copolymers of appropriate molecular weight (e.g., propene homopolymers, butene homopolymers, $C_3$ and $C_4$ $\alpha$-olefin copolymers, and the like) are suitable. Most preferably, the substituent is a polypropenyl or a polyisobutenyl group formed from polypropene or polyisobutene having a number average molecular weight (as determined by gel permeation chromatography) in the range of 700 to 2200, preferably 900 to 1100, most preferably 940 to 1000.

Likewise, processes for the formation of the hydrocarbyl substituted Mannich base are well known in the art. A particularly useful process is contained in U.S. Pat. No. 4,231,759 incorporated herein by reference as if fully set forth. Typically the hydrocarbyl substituted Mannich base is formed by reacting (i) an alkyl or alkenyl substituted phenol, (ii) alkylenepolyamine or mixture of alkylenepolyamines, and (iii) formaldehyde, wherein the alkyl or alkenyl group of the substituted phenol contains from about 50 to about 500 carbon atoms and wherein (i), (ii), and (iii) are reacted in a ratio within the range of from 1.0:0.1–10:0.1–10.

Polyalkylphenols may be obtained by the alkylation, in the presence of an alkylating catalyst such as $BF_3$, of phenol with high molecular weight polypropylene, polybutylene and other polyalkylene compounds to give alkyl substituents on the benzene ring of phenol having a number average molecular weight (Mn) of from about 600 to about 14,000.

The alkyl substituents of the phenolic compounds may be derived from high molecular weight polypropylenes, polybutenes, and other polymers of mono-olefins, principally 1-mono-olefins. Also useful are copolymers of mono-olefins with monomers copolymerizable therewith wherein the copolymer molecule contains at least 90% by weight, of mono-olefin units. Specific examples are copolymers of butenes (butene-1, butene-2, and isobutylene) with monomers copolymerizable therewith wherein the copolymer molecule contains at least 90% by weight of propylene and butene units, respectively. Said monomers copolymerizable with propylene or said butenes include monomers containing a small proportion of unreactive polar groups such as chloro, bromo, keto, ether, aldehyde, which do appreciably lower the oil-solubility of the polymer. The comonomers polymerized with propylene or said butenes may be aliphatic and can also contain non-aliphatic groups, e.g., styrene, methylstyrene, p-dimethylstyrene, divinyl benzene and the like. From the foregoing limitation placed on the monomer copolymerized with propylene or said butenes, it is clear that said polymers and copolymers of propylene and said butenes are substantially aliphatic hydrocarbon polymers. Thus, the resulting alkylated phenols contain substantially alkyl hydrocarbon substituents having a number average molecular weight (Mn) of from about 600 to about 14,000.

In addition to the foregoing hydroxyaromatic compounds, other phenolic compounds which may be used include, high molecular weight alkyl-substituted derivatives of resorcinol, hydroquinone, cresol, catechol, xylenol, hydroxydiphenyl, benzylphenol, phenethylphenol, naphthol, tolylnaphthol, among others. Preferred for the preparation of Mannich condensation products are the polyalkylphenol reactants, e.g., polypropylphenol and polybutylphenol whose alkyl group has a number average molecular weight of 600–3000, the more preferred alkyl groups have a number average molecular weight of 740–1200, while the most preferred alkyl group is a polypropyl group having a number average molecular weight of 800–950, most preferably about 900.

The preferred configuration of the alkyl-substituted hydroxyaromatic compound is that of a para-substituted monoalkylphenol. However, any alkylphenol readily reactive in the Mannich condensation reaction may be employed. Accordingly, ortho mono-alkylphenols and dialkylphenols are suitable for use in this invention.

Representative polyamine reactants used in forming the hydrocarbyl-substituted detergent/dispersants are alkylene polyamines, principally polyethylene polyamines. Other representative organic compounds containing at least one HN< group suitable for use in the preparation of the succinic or Mannich reaction products are well known and include the mono and diamino alkanes and their substituted analogs, e.g., ethylamine, dimethylamine, dimethylaminopropyl amine, and diethanol amine; aromatic diamines, e.g., phenylene diamine, diamino naphthalenes; heterocyclic amines, e.g., morpholine, pyrrole, pyrrolidine, imidazole, imidazolidine, and piperidine; melamine and their substituted analogs.

The alkylene polyamine reactants which are useful with this invention include polyamines which are linear, branched, or cyclic; or a mixture of linear, branched and/or cyclic polyamines wherein each alkylene group contains from about 1 to about 10 carbon atoms. A preferred polyamine is a polyamine containing from 2 to 10 nitrogen atoms per molecule or a mixture of polyamines containing an average of from about 2 to about 10 nitrogen atoms per molecule such as ethylenediamine, diethylene triamine, triethylene tetramine, tetraethylene pentamine, pentaethylene hexamine, hexaethylene heptamine, heptaethylene octamine, octaethylene nonamine, nonaethylene decamine, and mixtures of such amines. Corresponding propylene polyamines, including propylene diamine, dipropylene triamine, tripropylene tetramine, tetrapropylene pentamine, and pentapropylene hexamine are also suitable reactants. A particularly preferred polyamine is a polyamine or mixture of polyamines having from about 3 to 7 nitrogen atoms with diethylene triamine or a combination or mixture of ethylene polyamines whose physical and chemical properties approximate that of diethylene triamine being the most preferred. In selecting an appropriate polyamine, consideration should be given to the compatibility of the resulting detergent/dispersant with the gasoline fuel mixture with which it is mixed.

Ordinarily the most highly preferred polyamine, diethylene triamine, will comprise a commercially available mixture having the general overall physical and/or chemical composition approximating that of diethylene triamine but which can contain minor amounts of branched-chain and cyclic species as well as some linear polyethylene polyamines such as triethylene tetramine and tetraethylene pentamine. For best results, such mixtures should contain at least 50% and preferably at least 70% by weight of the linear polyethylene polyamines enriched in diethylene triamine.

The alkylene polyamines are usually obtained by the reaction of ammonia and dihalo alkanes, such as dichloro alkanes. Thus, the alkylene polyamines obtained by reacting from 2 to 11 moles of ammonia with a suitable amount of dichloro alkane having 2 to 6 carbon atoms and the chlorines on different carbons, thus provides useful alkylene polyamine reactants. For example, to obtain diethylene triamine, at least about 2 moles of dichloro alkane are reacted with at least about 3 moles of ammonia.

Representative aldehydes for use in preparing the Mannich reaction products of this invention include the aliphatic aldehydes such as formaldehyde, acetaldehyde, propionaldehyde, butyraldehyde, valeraldehyde, caproaldehyde, heptaldehyde, stearaldehyde. Aromatic aldehydes which may be used include benzaldehyde and salicylaldehyde. Illustrative heterocyclic aldehydes for use herein are furfural and thiophene aldehyde, etc. Also useful are formaldehyde-producing reagents such as paraformaldehyde, or aqueous formaldehyde solutions such as formalin. Most preferred is formaldehyde or formalin.

It is to be understood that the hydrocarbyl substituted succinimide or Mannich base reaction product component of this invention contains a significant portion of inactive ingredients. Subsequent to the manufacture of the hydrocarbyl substituted succinimide or Mannich base reaction product, solvent is typically added to dilute the product. Solvent may be present in the product in a minor amount, e.g., less than 20 wt. % of the recovered reaction product composition. Typically, however, the solvent is present or is added to reaction product so as to dilute the reaction product. The amount of solvent will generally range from about 45 to about 55 wt. % based on the total weight of product plus solvent. Thus only about 25 to about 45 wt. % of the hydrocarbyl substituted succinimide or Mannich base reaction product component of the detergent/dispersant is an active ingredient, the balance being solvent. A generally used solvent is a mixture of o-, p-, and m-xylene, mesitylene, and higher boiling aromatics such as Aromatic 150 (commercially available from Chemtech).

In addition to the detergent/dispersant, the additive concentrate typically contains a demulsifier. A wide variety of demulsifiers are available for use in the practice of this invention, including, for example, organic sulfonates, polyoxyalkylene glycols, oxyalkylated phenolic resins, and like materials. Particularly preferred are mixtures of alkylphenol or polyoxyalkylene glycols, and oxyalkylated alkylphenolic resins, such as are available commercially from Petrolite Corporation under the TOLAD trademark or from Aquaness Chemicals under the PETROKLEAR trademark. Such demulsifiers include TOLAD 9362, TOLAD 286, TOLAD 9310, and TOLAD 9308. While typically used in the additive packages, the demulsifiers tend to reduce the storage stability of the additive concentrate. Accordingly, it has been found that upon storage, the additive package may become cloudy and/or various components of the package may tend to precipitate thereby reducing the homogeneity of the additive package. Since some of the components are used in minor amounts, even a small variation in the homogeneity of the package can have a tremendously adverse affect on the performance of a fuel or lubricant containing the additive package. This invention provides a means for maintaining the homogeneity of the additive package, even with long term storage thereof.

For the purposes of this invention, the detergent/dispersant may consist of the foregoing hydrocarbyl-substituted succinimide, or the hydrocarbyl substituted Mannich base reaction product alone, or the detergent/dispersant may be used as an additive concentrate containing the succinimide, or Mannich base reaction product in combination with one or more carrier fluids selected from polyol compounds, poly-α-olefins, and mineral oil diluents.

Suitable polyol compounds which may be used in the detergent/dispersant additive concentrates of this invention can be represented by the following formula $$R_1—(R_2—0)_n—R_3$$

wherein $R_1$ is hydrogen, or hydroxy, alkyl, cycloalkyl, aryl, alkyaryl, aralkyl, alkoxy, cycloalkoxy, amine or amino group having 1–200 carbon atoms, $R_2$ is an alkylene group having 2–10 carbon atoms, and $R_3$ is hydrogen or alkyl, cycloalkyl, aryl, alkyaryl, aralkyl, alkoxy, cycloalkoxy, amine or amino group having 1–200 carbon atoms, and n is an integer from 1 to 500 representing the number of repeating alkoxy groups. Preferred polyol compounds are polyoxyalkylene glycol compounds and monoether derivatives thereof comprised of repeating units formed by reacting an alcohol with an alkylene oxide. The most preferred polyoxyakylene glycol derivative compound useful in the compositions and methods of this invention is known commercially as EMKAROX AF22 available from ICI Chemicals & Polymers Ltd. This compound has a pour point of about −42° C., a density of about 0.980 g/ml at 20° C., an open cup flash point of about 230° C. ,a viscosity of about 90 cSt at 40° C. and about 17 cSt at 100° C., and a viscosity index of about 200. The number average molecular weight of the polyoxyalkylene compounds of this invention is preferably in the range of from about 200 to about 5000, more preferably from about 500 to about 3,000, and most preferably from about 1,000 to about 2,000.

The polyoxyalkylene compounds of this invention may be prepared by condensation of the corresponding oxides, or oxide mixtures, such as ethylene or 1,2-propylene oxides as set forth more fully in U.S. Pat. Nos. 2,425,755; 2,425,845; 2,448,664; and 2,457,139 incorporated herein by reference as if fully set forth.

As used herein, poly-α-olefins (PAO) are primarily trimers, tetramers and pentamers of alphaolefin monomers containing from 6 to 12, generally 8 to 12 and most preferably about 10 carbon atoms. Their synthesis is outlined in Hydrocarbon Processing. Feb. 1982, page 75 et seq. and essentially comprises catalytic oligomerization of short chain linear alpha olefins (suitably obtained by catalytic treatment of ethylene). The nature of an individual PAO depends in part on the carbon chain length of the original alphaolefin, and also on the structure of the oligomer. The exact molecular structure may vary to some extent according to the precise conditions of the oligomerization, which is reflected in changes in the physical properties of the final PAO. Since the suitability of a particular PAO is determined primarily by its physical properties, and in particular its viscosity, the various products are generally differentiated and defined by their viscosity characteristics. According to the present invention, polyalphaolefins having a viscosity (measured at 100° C.) from 2 to 20 centistokes are particularly desirable for forming fuel additive compositions of this invention. Preferably, the polyalphaolefin has a viscosity of at least 4–20 centistokes, and most preferably about 8–10 centistokes at 100° C.

When poly-α-olefins are present in the detergent/dispersant additive concentrate of this invention, it is highly desirable to also include an oxidation inhibitor or antioxidant. Various compounds known for use as oxidation inhibitors can be utilized in the practice of this invention. These include phenolic antioxidants, amine antioxidants, sulfurized phenolic compounds, and organic phosphites, among others. For best results, the antioxidant should be composed predominantly or entirely of either (1) a hindered phenol antioxidant such as 2-tert-butylphenol, 2,6-di-tert-butylphenol, 2,4,6-tri-tert-butylphenol, 4-methyl-2,6-di-tert-butylphenol, 4,4'-methylenebis-(2,6-di-tert-butylphenol), and mixed methylene bridged polyalkyl phenols, or (2) an aromatic amine antioxidant such as the cycloalkyl-di-lower alkyl amines, and phenylenediamines, or a combination of one or more such phenolic antioxidants with one or more such amine antioxidants. Particularly preferred for use in the practice of this invention are tertiary butyl phenols, such as 2,6-di-tert-butylphenol, 2,4,6-tri-tert-butylphenol, o-tert-butylphenol. The amount of oxidation inhibitor or antioxidant is preferably a stabilizing amount. Typically the stabilizing amount ranges from about 1 part of oxidation inhibitor or antioxidant to 10 to 20 parts of poly-α-olefin.

Suitable mineral oils for use with this invention include the naturally occurring paraffinic, naphthenic, and asphaltic mineral oils. Suitable paraffinic mineral oils have a viscosity of 100 to 4500 SUS at 38° C. such as that obtained as the lubrication oil fraction of a Mid-Continent crude oil. Such an oil will have a paraffin content of less than about 35 volume percent. Particularly preferred is a Mid-Continent solvent-refined paraffinic neutral oil having a viscosity of about 300 to 325 SUS at 38° C. Naphthenic and asphaltic mineral oils are defined generally as those found along the Gulf Coast such as a Coastal Pale (commercially available from Exxon Co.). A typical Coastal Pale may contain about 3–5 wt. % polar material, 20–35 wt. % aromatic hydrocarbons, and 50–75 wt. % saturated hydrocarbons and have a molecular weight in the range of from about 300 to about 600. Asphaltic oils are defined as containing high molecular weight (ca>800) compounds with high polar functionality and little or no pure hydrocarbon type compounds. Principal polar functionalities generally present in such asphaltic oils include carboxylic acids, phenols, amides, carbazoles, and pyridine benzologs. Typically, asphaltenes contain about 40–50% by weight aromatic carbon and have molecular weights of several thousand. Asphaltic oils are generally found along the West Coast. Preferably the mineral oil has a viscosity at 38° C. of less than about 1600 SUS, more preferably less than about 1500 SUS, and most preferably between about 800 and 1500 SUS at 38° C. It is highly desirable that the mineral oil have a viscosity index of less than about 90, more particularly, less than about 70 and most preferably in the range of from about 30 to about 60. Suitable naphthenic or asphaltic mineral oils may be selected from solvent extracted, hydrotreated, and non-hydrotreated oils, however, the hydrotreated mineral oils are particularly desirable for use in the detergent/dispersant additive concentrates of this invention.

For best results, the detergent/dispersant additive concentrate compositions should contain from about 0.5 to about 4 parts (preferably from about 1 to about 2 parts) of hydrocarbyl substituted succinimide or Mannich base reaction product per part of carrier fluid.

The above additive compositions of this invention are preferably employed in hydrocarbon mixtures in the gasoline boiling range or hydrocarbon/oxygenate mixtures, or oxygenates, but are also suitable for use in middle distillate fuels, notably, diesel fuels and fuels for gas turbine engines. The nature of such fuels is so well known to those skilled in the art as to require no further comment. By oxygenates is meant alkanols and ethers such as methanol, ethanol, propanol, methyl-tert-butyl ether, ethyl-tert-butyl ether, tert-amyl-methyl ether and the like, or combinations thereof.

Other components may be used in the additive package including oxidation inhibitors or antioxidants, corrosion inhibitors, emission control additives, lubricity additives, antifoams, biocides, dyes, octane or cetane improvers, extreme pressure agents, metallic combustion improvers, and the like.

The practice of this invention is illustrated by the following non-limiting examples.

EXAMPLE 1

A detergent/dispersant package containing 38.1 wt. percent Mannich base detergent/dispersant (Hi-TEC®4997 additive available commercially from Ethyl Petroleum Additives, Inc.), 38.1 wt. percent 600 SN mineral oil and 23.8 wt. percent Super High Flash Naphtha was formed as a base package mixture (Base). To the base package was added the demulsifiers and 2-ethylhexanol in the amounts indicated in Table 1. To determine the storage stability of the mixture, 200 grams of each mixture was placed in a 473 mL jar along with a 1.2×4.0 cm Teflon coated stir bar. The mixtures were magnetically stirred without cavitation for 24 hours at room temperature. After stirring, 100 mL of each mixture was placed in a pear shaped centrifuge tube with an extended elongated nipple graduated in 0.01 mL increments. The sample was then centrifuged at 1400–1500 relative centrifuge force (rcf) for 30 minutes. Upon completion of the centrifuge process, the volumetric percent sediment as indicated by the graduated nipple was determined. Storage stable packages typically have 0.02 vol. % sediment or less.

TABLE 1

| # | Base (parts) | TOLAD-9310 (parts) | TOLAD-286 (parts) | 2-ethylhexanol (parts) | Sediment (vol. %) |
|---|---|---|---|---|---|
| 1 | 98.6 | 1.4 | — | — | 0.060 |
| 2 | 99.9 | — | 0.14 | — | 0.010 |
| 3 | 99.5 | — | 0.50 | — | 0.040 |
| 4 | 99.0 | — | 1.0 | — | 0.055 |
| 5 | 98.6 | — | 1.4 | — | 0.080 |
| 6 | 97.2 | 1.4 | — | 1.4 | 0.032 |
| 7 | 96.6 | 1.4 | — | 2.0 | 0.019 |
| 8 | 96.4 | 1.4 | — | 2.5 | 0.013 |
| 9 | 95.5 | 1.4 | — | 3.0 | 0.000 |

EXAMPLE 2

Diesel Fuel Additive Concentrate Package

A fuel additive package is prepared by mixing 40.8 parts of succinimide based detergent/dispersant (Hi-TEC®9645, additive commercially available from Ethyl Petroleum Additives, Inc.), 40.8 parts of Super High Flash Naphtha, 6.12 parts of demulsifier (LB-9324 available from Aquaness Chemical), 6.12 parts of $C_{12}$–$C_{14}$ t-alkyl amine mixture (PRIMENE 81R), 4.08 parts of tetrapropenyl succinic acid (50 wt. % solution in Aromatic 150 solvent), and 2.04 parts of MDA-80 metal deactivator (N,N-disalicylidene-1,2propylenediamine). To this mixture was added various alcohols in the amounts indicated in Table 2.

TABLE 2

| Alcohol | Alcohol (parts) | Package (parts) | Sediment (vol. %) |
|---|---|---|---|
| n-butanol | 9.26 | 90.74 | 0.155 |
| n-octanol | 9.26 | 90.74 | 0.080 |
| n-decanol | 9.26 | 90.74 | 0.060 |
| EPAL ® 610 alcohol* | 9.26 | 90.74 | 0.025 |
| EPAL ® 1214 alcohol** | 9.26 | 90.74 | 0.010 |
| EPAL ® 1214 alcohol** | 9.26 | 90.74 | 0.015 |
| isocetyl alcohol | 9.26 | 90.74 | trace |
| EPAL ® 1214 alcohol** | 6.67 | 93.33 | <0.010 |
| EPAL ® 1214 alcohol** | 4.85 | 95.15 | 0.017 |
| EPAL ® 1214 alcohol** | 2.97 | 97.03 | 0.022 |
| isocetyl alcohol | 9.26 | 90.74 | 0.025 |
| isocetyl alcohol | 6.67 | 93.33 | 0.025 |
| isocetyl alcohol | 4.85 | 95.15 | 0.028 |

TABLE 2-continued

| Alcohol | Alcohol (parts) | Package (parts) | Sediment (vol. %) |
|---|---|---|---|
| isocetyl alcohol | 2.97 | 97.03 | 0.030 |

* — EPAL ® 610 alcohol (a product of Ethyl Corporation) is a mixture of n-$C_6$, n-$C_8$, and n-$C_{10}$ alkyl alcohols
** — EPAL ® 1214 alcohol (a product of Ethyl Corporation) is a mixture of n-dodecanol, n-tetradecanol, and n-hexadecanol Variations of the invention are within the spirit and scope of the ensuing claims.

What is claimed is:

1. An additive concentrate package characterized by having an enhanced shelf-life stability comprising
   a) a major amount of detergent/dispersant;
   b) a minor amount of demulsifier; and
   c) an amount of solvent stabilizer composition sufficient to enhance the shelf-life stability of the additive package wherein the solvent stabilizer composition contains at least one liquid aromatic hydrocarbon solvent and at least one liquid alkyl or cycloalkyl alcohol and wherein the weight ratio of aromatic solvent to alcohol is within the range of from about 2:1 to about 25:1.

2. The additive concentrate package of claim 1 wherein the liquid alcohol is a liquid $C_4$–$C_{16}$ alkanol or a liquid mixture of $C_4$–$C_{16}$ alkanols.

3. The additive concentrate package of claim 1 wherein the solvent stabilizer composition comprises from about 75 weight percent to about 90 weight percent aromatic solvent and from about 10 weight percent to about 25 weight percent of a liquid $C_4$–$C_{16}$ alkanol or a liquid mixture of $C_4$–$C_{16}$ alkanols.

4. The additive concentrate package of claim 3 wherein the liquid alkanol is predominantly 2-ethylhexanol.

5. The additive concentrate package of claim 1 wherein the detergent/dispersant is a reaction product of (i) an alkyl or alkenyl substituted phenol, (ii) a alkylenepolyamine or mixture of alkylenepolyamines, and (iii) formaldehyde, wherein the alkyl or alkenyl group of the substituted phenol contains from about 50 to about 500 carbon atoms and wherein (i) , (ii), and (iii) are reacted in a ratio within the range of from 1.0:0.1–10:0.1–10.

6. The additive concentrate package of claim 1 wherein the liquid aromatic hydrocarbon solvent is Super High Flash Naphtha.

7. The additive concentrate package of claim 4 wherein the detergent/dispersant is a reaction product of (i) an alkyl or alkenyl substituted phenol, (ii) a alkylenepolyamine or mixture of alkylenepolyamines, and (iii) formaldehyde, wherein the alkyl or alkenyl group of the substituted phenol contains from about 50 to about 160 carbon atoms and wherein (i), (ii), and (iii) are reacted in a ratio within the range of from 1.0:0.1–10:0.1–10.

8. The additive concentrate package of claim 6 wherein the detergent/dispersant comprises the reaction product of (i) an alkyl or alkenyl substituted phenol, (ii) a alkylenepolyamine or mixture of alkylenepolyamines approximating diethylene triamine, and (iii) formaldehyde, wherein the alkyl or alkenyl group has a number average molecular weight in the range of from about 750 to about 2200 and wherein (i), (ii), and (iii) are reacted in a ratio within the range of from 1.0: 0.1–10:0.1–10.

9. The additive concentrate package of claim 8 wherein the weight ratio of liquid alcohol to demulsifier is within the range of from about 2.5 to about 35 parts of alcohol per part of demulsifier.

10. The additive concentrate package of claim 9 wherein the detergent/dispersant further comprises carrier fluid wherein the ratio of detergent dispersant to carrier fluid is from about 1 to about 2 parts of detergent/dispersant per part of carrier fluid.

11. The additive concentrate package of claim 10 wherein the carrier fluid is 4–20 cst poly-α-olefin.

12. The additive concentrate package of claim 11 wherein the detergent/dispersant further comprises a stabilizing amount of hindered phenol antioxidant.

13. A method for enhancing the shelf-life stability of an additive concentrate package comprising
   a) forming an additive concentrate package containing a major amount of detergent/dispersant and a minor amount of demulsifier; and
   b) admixing an effective amount of solvent stabilizer composition with said additive package, said effective amount being sufficient to improve the shelf-life stability of the additive package wherein the solvent stabilizer composition comprises at least one liquid aromatic hydrocarbon solvent and at least one liquid alkyl or cycloalkyl alcohol and wherein the weight ratio of aromatic solvent to alcohol is within the range of from about 2:1 to about 25:1.

14. The method of claim 13 wherein the alcohol is a liquid $C_4$–$C_{16}$ alkanol or a liquid mixture of $C_4$–$C_{16}$ alkanols.

15. The method of claim 13 wherein the solvent stabilizer composition comprises from about 75 weight percent to about 90 weight percent liquid aromatic solvent and from about 10 weight percent to about 25 weight percent of a liquid $C_4$–$C_{16}$ alkanol or a liquid mixture of $C_4$–$C_{16}$ alkanols.

16. The method of claim 15 wherein the liquid alkanol is predominantly 2-ethylhexanol.

17. The method of claim 13 wherein the detergent/dispersant is a reaction product of (i) an alkyl or alkenyl substituted phenol, (ii) a alkylenepolyamine or mixture of alkylenepolyamines, and (iii) formaldehyde, wherein the alkyl or alkenyl group of the substituted phenol contains from about 50 to about 500 carbon atoms and wherein (i), (ii), and (iii) are reacted in a ratio within the range of from 1.0: 0.1–10:0.1–10.

18. The method of claim 16 wherein the liquid aromatic hydrocarbon solvent is Super High Flash Naphtha.

19. The method of claim 18 wherein the detergent/dispersant is a reaction product of (i) an alkyl or alkenyl substituted phenol, (ii) a alkylenepolyamine or mixture of alkylenepolyamines, and (iii) formaldehyde, wherein the alkyl or alkenyl group of the substituted phenol contains from about 50 to about 160 carbon atoms and wherein (i), (ii), and (iii) are reacted in a ratio within the range of from 1.0: 0.1–10:0.1–10.

20. The method of claim 16 wherein the detergent/dispersant comprises the reaction product of (i) an alkyl or alkenyl substituted phenol, (ii) a alkylenepolyamine or mixture of alkylenepolyamines approximating diethylene triamine, and (iii) formaldehyde, wherein the alkyl or alkenyl group has a number average molecular weight in the range of from about 750 to about 2200 and wherein (i), (ii), and (iii) are reacted in a ratio within the range of from 1.0: 0.1–10:0.1–10.

21. The method of claim 19 wherein the weight ratio of liquid alcohol to demulsifier is within the range of from about 2.5 to about 35 parts of alcohol per part of demulsifier.

22. The method of claim 21 wherein the additive concentrate package is a fuel additive concentrate package.

23. The method of claim 13 wherein the additive concentrate package is a fuel additive concentrate package.

24. The method of claim 17 wherein the detergent/-dispersant further comprises carrier fluid wherein the ratio of detergent dispersant to carrier fluid is from about 1 to about 2 parts of detergent/dispersant per part of carrier fluid.

25. The method of claim 24 wherein the carrier fluid is 4–20 cst poly-α-olefin.

26. The method of claim 25 wherein the detergent/-dispersant further comprises a stabilizing amount of hindered phenol antioxidant.

* * * * *